United States Patent [19]

Simmons

[11] 4,029,140

[45] June 14, 1977

[54] METHOD OF AND MEANS FOR OBTAINING WHITE CAST IRON

[75] Inventor: William Simmons, Birmingham, England

[73] Assignee: The British Cast Iron Research Association, Birmingham, England

[22] Filed: Feb. 10, 1976

[21] Appl. No.: 656,872

[30] Foreign Application Priority Data

Apr. 1, 1975 United Kingdom ..... 13141/75
May 14, 1975 United Kingdom ..... 20454/75

[52] U.S. Cl. ..... 164/72; 164/349; 427/133

[51] Int. Cl.[2] ..... B22D 27/20

[58] Field of Search ..... 164/55, 72, 138, 349; 427/133, 134, 135; 249/114; 148/35; 75/123 CB

[56] References Cited

UNITED STATES PATENTS

| | | | |
|---|---|---|---|
| 2,234,152 | 3/1941 | Archer | 164/72 X |
| 2,250,488 | 7/1941 | Lorig et al. | 164/138 X |

*Primary Examiner*—Robert D. Baldwin
*Attorney, Agent, or Firm*—Scrivener Parker Scrivener & Clarke

[57] ABSTRACT

In an iron molding process and in a mold for carrying out the process, in which the mold is at least locally coated with tellurium or bismuth to promote the production of a white iron structure there is included in the coating a mineral substance such as a clay containing water which is loosely chemically combined, or a substance containing hydroxyl groups, the water or each hydroxyl group being chemically combined tightly enough so that it withstands the heat involved in drying of the mold but is liberated on contact with the molten iron.

10 Claims, No Drawings

METHOD OF AND MEANS FOR OBTAINING WHITE CAST IRON

This invention relates to a method of obtaining a white cast iron structure using coated molds. There are occasions when it is desirable to cause at least a portion of an iron casting, of a composition that would otherwise be expected to solidify with a more or less graphite structure, to solidify with a wholly or partially white structure, i.e. with the carbon present substantially wholly in combined form instead of as free graphite. For example, although white cast iron is very hard and brittle, and almost unmachineable, it is useful to have local regions of white iron structure at particular points in a casting which, in use, are going to be exposed to severe wear. This is commonly achieved by pouring the metal into a mold which has a metal chill incorporated at the appropriate part of the mold, so as to cause the molten iron to solidify rapidly and produce a white rather than a grey iron structure.

Another method is to incorporate a tellurium-containing or bismuth-containing material as a coating on the mold. When this is done at some local point in the mold a thin layer of white iron structure is generally found to be produced in the region adjacent to the coating; this process has been used from time to time to increase local hardness or to improve the soundness of particular regions of a casting.

Another important use of molds coated with tellurium-based or bismuth-based materials has been for the purpose of producing small cast samples for thermal analysis. By coating the inside of the whole of the mold with a tellurium-containing material it is possible to obtain a casting that is of white iron structure throughout; when a thermocouple is placed in the centre of the sample and the cooling curve (temperature against time) during solidification is plotted, the temperatures at which the arrests occur allow the carbon equivalent and the carbon and silicon contents to be calculated; success depends, however, on the achievement of a substantially completely white iron structure.

When the iron used to make the sample has a fairly high carbon equivalent, or where the iron has been heavily inoculated with a graphitising substance, then the extent to which the tellurium coating on the mold is able to produce a white iron structure is reduced.

The aim of the invention is therefore to enhance the ability of a tellurium or similar (e.g. bismuth) coating on a mold to result in a white iron structure, especially in the presence of high carbon equivalents and/or heavy inoculation.

According to the invention this is achieved by including in the mold coating a mineral material which contains water, loosely combined, or a material which contains some hydroxyl groups, the water or hydroxyl groups being sufficiently strongly combined to resist the normal drying of the mold but being able to be liberated at the temperature of the molten iron.

It will be appreciated that the use of free water, in the form of dampness, is out of the question because it would be turned to steam and cause serious rupture, but water loosely incorporated in a molecule such as that of a clay, will be liberated, when the molten iron comes into contact with the coating, in a sufficiently quiet manner to achieve the desired object without problems.

If, instead of water, one wants to use a material rich in hydroxyl groups, suitable materials are sugars such as glucose, and other similar carbohydrates.

The inclusion of the water-bearing or hydroxyl-bearing material in the coating may be carried out in a number of ways. For example it may be mixed with the tellurium- (or bismuth-) containing material and the resulting mixture is then applied to the mold. Alternatively the tellurium-containing substance may first be applied to the mold, followed by application of the water-containing or hydroxyl-containing material.

One way of applying the water-containing substance is to paint on to the surface of the mold a concentrated aqueous solution of the material to be added; another is to fill the mould with a concentrated solution of the material to be added, followed by draining off the excess solution. The mold is subsequently dried, for example by heating with a torch or in an oven. The mineral to be chosen must be able to liberate water vapour in contact with molten cast iron at a rate which is not sufficient to cause violent reaction, and after the application of the material in the form of a solution it is important that the mold surface should be dried sufficiently to avoid a violent reaction occurring as the result of any dampness.

Requirements for a practicable coating include producing a fluid mixture of the constituents which contains a good dispersion of the materials mixed, which will adhere tightly to the surface to which it is applied without spalling, both after drying and during casting of the metal, and which will produce a coating which will not react violently when the molten metal is poured against it. Furthermore, the properties of the coating to be applied should be such that after drying the final coating thickness will lie preferably in the range from 10 to 40 thousands of an inch produced by either a single or multiple application of the coating.

In order to achieve these objectives we have found that the useful constituents of the coating should contain the following; the tellurium (or bismuth) should be present as finely powdered metal or as a substance containing the element in a form which enable it to be liberated, to the extent of between 5 and 50 percent of the weight of solids in the mixture. The substance containing hydroxyl groups, water of crystallisation or loosely combined water should be present to the extent of between 5 and 25 percent of the weight of solids. Glucose has been found to be very satisfactory for this purpose. It is desirable to have a suspending agent to assist in the production of the coating mixture, and a clay is very useful for this purpose. A clay also has the benefit of containing some combined water and assists in binding the mixture to the surface of the mould. A clay of low swelling characteristics can be useful because it will have a lower tendency to crack and spall when dry than a clay of high swelling characteristics. The content of clay may conventionally be between 10 and 60 percent of the solids. To control the reaction of the molten metal with the coating; an inert filler material may be added to the mixture. Fine crushed silica sand to the extent of from 0 to 35 percent of the weight of total solids has been found useful.

A water-compatible binder is desirable, and should be chosen to confer the following:

a. Good adhesion to the mould and to any previously applied coating upon it.
b. Strength to resist the contraction of the coating during drying.

c. Good spalling resistance during casting the metal into the mould after the coating has been dried.

The amount of binder may be from 1 to 20 percent of the total weight of solids and may be either a solid or a liquid additive. Binders must be water-compatible adhesives, but a particularly suitable class of binders comprises water-soluble phenolic resins, including those containing carbohydrates.

The mixture is made workable by adding water in sufficient quantity to give a viscosity and density which will yield a satisfactory coating thickness by whatever method of application is chosen. Generally, the mixture may be specified as having greater than 40° Baume. During mixing it is desirable to allow adequate time for the clay to swell, which, depending on the type and amount of clay may be between 1 and 24 hours before the coating is applied. After application the surplus moisture must be allowed to drain from the coating before successive coatings are applied. Coatings are dried by allowing them to stand in air at room temperature or in warm air, which should not exceed in temperature the break-down temperature of any of the constituents.

The tellurium-containing material may be in the form of tellurium oxide and, where bismuth is used instead, this may be in the form of sodium bismuthate. Yet another possibility is to use a material containing tellurium and bismuth, for example sodium telluro-bismuthite.

It will be appreciated that it is impossible to provide an exhaustive list of those materials that will achieve the object of the invention. It is essential that the material should contain either water or a molecule with hydroxyl groups, and that in each case the water or hydroxyl groups should be capable of being retained (unlike free moisture) when the mold is dried at normal drying temperatures at least 100° C (for example 120° C) yet should be readily liberated at the temperature of the molten metal (say above 1200° C). This is ture of many clays, where the water molecules are trapped in the interstices of the complex molecular lattice structure of the clay. Many materials contain hydroxyl groups but some are unsuitable on grounds of cost or of difficulty in handling. Sugars are especially suitable, simply because they are characterised by having several hydroxyl groups in each molecule, and they withstand the mould-drying temperature yet decompose at molten metal temperatures to liberate the hydroxyl groups.

Some examples of the use of water-containing and hydroxyl-containing materials in accordance with the invention, for producing white iron castings, will now be described.

One could use an available hydrated mineral, containing water of crystallisation, or a mineral clay, which contains water molecules trapped in its interstices. Suitable minerals are:

Aluminite
Cacoxenite
Chalcanthite
Colemanite
Coquimbite
Dioptase
Goslanite
Melantenite
Gypsum
Alunogenite
Perlite
Zeolites
Scapolytes Suitable clays may include:

Kaolinites
Montmorillonites
Illites
Halloysites

The following examples illustrate the use of tellurium metal powder in conjunction with a hydroxyl-containing substance (glucose) as well as a clay as a suspending agent and a phenolic resin as a binder.

EXAMPLE I

A coating mixture was prepared having the following proportions:

Tellurium metal powder—20 percent of the weight of solids
Glucose—25 percent of the weight of solids
China clay—55 percent of the weight of solids
Liquid water-soluble sugar-phenol-formaldehyde resin—10 percent of the weight of solids
Water to produce a workable mixture of 40° Be—50–60 percent of the weight of solids The mixture was prepared by mixing the clay and the glucose in the dry state. The resin was mixed with half of the water and then mixed with the clay/glucose mixture until thoroughly wetted. Mixing continued intermittently for 2–3 hours to allow the clay to swell. The mixture was then diluted to between 50° and 60° Be after which the tellurium powder was added. The whole was stirred for a few minutes and then the remaining water was added to achieve 40° Baume.

The mixture, which was kept periodically stirred, was used to coat shell-molded thermal analysis sample molds for the determination of carbon equivalent, carbon and silicon contents. Each mold contained a silica-sheathed thermocouple with its junction located below the mid-height of the mold. The mold was filled with the coating mixture and then inverted to allow excess coating and moisture to drain out. After about half a minute a second layer of coating was applied by the same means. The two-layer coating was then dried in an oven at 105° C for 3 hours and afterwards the thickness of the dried coating was approximately 30 thousands of an inch.

The thermal analysis molds so treated were used to obtain white iron samples from liquid cast iron in two foundries. In each case the metal would normally have solidified as grey cast iron, having a fairly high carbon equivalent content, a high degree of nucleation and minor elements which would promote a graphitisation. Difficulty had previously been experienced with conventionally tellurium treated molds in obtaining a sample with a white iron eutectic structure. The major composition range of the iron in foundry A was:

| | | | |
|---|---|---|---|
| Carbon | 3.29 – 3.54% | Nickel | 0.20% |
| Silicon | 1.99 – 2.81% | Copper | 0.43 – 0.56% |
| Manganese | 0.53 – 0.71% | | |
| Sulphur | 0.088 – 0.117% | | |
| Phosphorous | 0.096% | | |
| CEV | 3.78 – 4.5% | | |

The major composition range of the iron foundry B was:

| | | | |
|---|---|---|---|
| Carbon | 3.16 – 3.44% | Nickel | 0.57% |
| Silicon | 2.40 – 2.4% | Copper | 0.4% |
| Manganese | 0.74% – 0.82% | | |
| Sulphur | 0.088 – 0.110% | | |
| Phosphorus | 0.071 – 0.08% | | |
| CEV | 3.98 – 4.27% | | |

All the samples cast in each foundry solidified with completely white eutectic structures and gave cooling curves which were characteristic of white cast irons.

EXAMPLE II

The mixture was similar to that of Example I described above, but the glucose content was reduced to 10 percent of the weight of the solids and 15 percent of the weight of the solids was made up of finely crushed silica sand. The mixture was made in the same way as previously, but the silica sand was added at the same time as the tellurium powder. The molds were coated with two layers of the coating in the same way as in the first example, and they were used for pouring samples of iron of the following nominal composition:

| | | | |
|---|---|---|---|
| Carbon | 3.5% | Nickel | up to 0.25% |
| Silicon | 2.5% | Copper | up to 1% |
| Manganese | 0.4% | | |
| Sulphur | 0.12% | | |
| Phosphorus | 0.07% | | |
| CEV | 4.4% | | |

In this case the metal was deliberately heavily inoculated and contained the graphitising elements Copper and Nickel before casting, and 14 samples were made. Every one solifified with a cooling curve characteristic of the white iron eutectic and all contained white iron eutectic structures. Although the coatings in the earlier Example I containing 25 percent of glucose, had shown evidence of 'splitting' when the molten metal samples were poured, those in the present example VIII containing 10 percent of glucose and 15 percent of fine silica sand, showed little evidence of such reaction when the metal was poured.

It will be understood that where we speak of coating a portion, or all, of the surface of the cavity of a mold we include within the phrase the possibility of coating not the female mold but part or all of an insert in that mold, for example of an inserted core.

I claim:

1. A method of making an iron casting containing at least a region of white iron comprising coating at least a portion of the internal surface of a mold with a material containing a white-iron-promoting material selected from the class consisting of tellurium and bismuth and compounds thereof and containing in addition a mineral substance which contains water in a loosely chemically combined form, said water being bound sufficiently tightly within said mineral substance to withstand drying heat of said mold but capable of being liberated from said mineral substance at the temperature of the molten iron, drying said coating, and pouring molten iron into said mold whereby said water is liberated to produce at least a region of white iron.

2. The method set forth in claim 1 wherein said substance is a clay of the type capable of containing water molecules trapped in its interstices.

3. A method of making an iron casting containing at least a region of white iron comprising coating at least a portion of the internal surface of a mold with a material containing a white-iron-promoting material selected from the class consisting of tellurium and bismuth and compounds thereof and containing in addition a substance which contains hydroxyl groups, said hydroxyl groups being bound sufficiently tightly within said substance to withstand drying heat of said mold but capable of being liberated from said substance at the temperature of the molten iron, drying said mold, and pouring molten iron into said mold whereby said hydroxyl groups are liberated to produce at least a region of white iron.

4. the method set forth in claim 3 wherein said substance is an organic compound.

5. The method set forth in claim 4 wherein said organic compound is a sugar.

6. A mold for making an iron casting containing at least a region of white iron, said mold comprising a body defining a mold cavity, at least a portion of the surface of the cavity being coated with a material containing a white-iron-promoting material selected from the class consisting of tellurium and bismuth and compounds thereof and containing in addition a mineral substance which contains water, said water being bound sufficiently tightly within said mineral substance to withstand drying heat of said mold but being such as to be liberated from said mineral substance at the temperature of the molten iron.

7. The mold set forth in claim 6 wherein said substance is a clay.

8. A mold for making an iron casting containing at least a region of white iron, said mold comprising a body defining a mold cavity, at least a portion of the surface of the cavity being coated with a material containing a white-iron-promoting material selected from the class consisting of tellurium and bismuth and compounds thereof and containing in addition a substance which contains hydroxyl groups, said hydroxyl groups being bound sufficiently tightly within said substance to withstand drying heat of the mold but being such as to be liberated from said substance at the temperature of the molten iron.

9. The mold set forth in claim 8 wherein said substance is an organic compound.

10. The mold set forth in claim 9 wherein said organic compound is a sugar.

* * * * *